US007789685B2

(12) United States Patent
Hickam

(10) Patent No.: US 7,789,685 B2
(45) Date of Patent: Sep. 7, 2010

(54) ELECTRICAL SHORTING SYSTEM

(75) Inventor: Christopher D. Hickam, Glasford, IL (US)

(73) Assignee: Caterpillar Inc, Peoria, IL (US)

( * ) Notice: Subject to any disclaimer, the term of this patent is extended or adjusted under 35 U.S.C. 154(b) by 890 days.

(21) Appl. No.: 11/640,740

(22) Filed: Dec. 18, 2006

(65) Prior Publication Data

US 2008/0142344 A1 Jun. 19, 2008

(51) Int. Cl.
*H01R 13/703* (2006.01)

(52) U.S. Cl. ..... 439/188; 200/51.1

(58) Field of Classification Search ..... 439/188; 200/51.1, 51.09; 361/55, 56
See application file for complete search history.

(56) References Cited

U.S. PATENT DOCUMENTS 3,512,043 A 5/1970 Werner et al.
3,523,268 A * 8/1970 Foster ..... 439/76.1
3,970,785 A 7/1976 Meyer
4,090,227 A 5/1978 Schweitzer
4,212,507 A 7/1980 Bunnell
4,229,688 A 10/1980 Knox et al.
4,628,818 A 12/1986 Nilsson
4,820,193 A 4/1989 Noorily
4,952,758 A * 8/1990 Dara et al. ..... 200/51.09
4,955,823 A 9/1990 Luzzi
4,962,462 A 10/1990 Fekete
4,971,568 A 11/1990 Cronin
5,004,435 A 4/1991 Jammet
5,061,196 A 10/1991 Weston et al.
5,075,813 A 12/1991 Takabayashi
5,134,320 A 7/1992 Perusse
5,177,426 A 1/1993 Nakanishi et al.
5,225,958 A 7/1993 Nakamura
5,238,422 A 8/1993 Scherer
5,252,082 A 10/1993 Hsieh et al.
5,267,868 A 12/1993 Wolff, Jr.
5,352,128 A 10/1994 Bricaud
5,353,185 A 10/1994 Bodkin
5,357,089 A 10/1994 Prentice
5,401,180 A 3/1995 Muzslay
5,425,649 A 6/1995 Reymond
5,486,992 A 1/1996 Koscica et al.
5,518,411 A 5/1996 Belleci
5,584,713 A 12/1996 Kato et al.

(Continued)

FOREIGN PATENT DOCUMENTS

DE 35 04 560 8/1986

(Continued)

*Primary Examiner*—Neil Abrams
(74) *Attorney, Agent, or Firm*—Richard K. Chang

(57) ABSTRACT

An electrical shorting system includes an electrical switch having a first terminal, a second terminal, and a switching terminal. The electrical shorting system also includes a housing, a first contact in electrical communication with the first terminal of the electrical switch and supported by the housing, and a second contact in electrical communication with the second terminal of the electrical switch and supported by the housing. The electrical switch may be in a closed state in which the first contact is shorted with the second contact through the electrical switch, and when a voltage is applied to the switching terminal, the electrical switch is placed in an open state that impedes current flow through the electrical switch between the first contact and the second contact.

20 Claims, 2 Drawing Sheets

U.S. PATENT DOCUMENTS

| | | | | |
|---|---|---|---|---|
| 5,667,389 | A | 9/1997 | Kidd et al. | |
| 5,697,501 | A | 12/1997 | Johansen | |
| 5,714,869 | A * | 2/1998 | Tamechika et al. | 320/101 |
| 5,726,505 | A | 3/1998 | Yamada et al. | |
| 5,757,600 | A | 5/1998 | Kiraly | |
| 5,763,814 | A | 6/1998 | Avory et al. | |
| 5,828,261 | A | 10/1998 | Antone et al. | |
| 5,949,160 | A | 9/1999 | Anderson et al. | |
| 5,989,046 | A | 11/1999 | Togashi | |
| 5,998,885 | A | 12/1999 | Tamor et al. | |
| 6,043,965 | A | 3/2000 | Hazelton et al. | |
| 6,049,143 | A | 4/2000 | Simpson et al. | |
| 6,167,291 | A | 12/2000 | Barajas et al. | |
| 6,196,858 | B1 | 3/2001 | Matsumoto et al. | |
| 6,259,170 | B1 * | 7/2001 | Limoge et al. | 307/10.8 |
| 6,278,598 | B1 | 8/2001 | Suzuki et al. | |
| 6,409,526 | B1 | 6/2002 | Malone et al. | |
| 6,476,571 | B1 | 11/2002 | Sasaki | |
| 6,652,001 | B2 | 11/2003 | Furui | |
| 6,657,475 | B1 | 12/2003 | Zahn | |
| 6,765,804 | B2 | 7/2004 | Hudson et al. | |
| 6,770,986 | B2 | 8/2004 | Nagao et al. | |
| 6,835,079 | B2 | 12/2004 | Gentry et al. | |
| 6,838,923 | B2 | 1/2005 | Pearson | |
| 6,979,787 | B2 | 12/2005 | Davies | |
| 6,992,463 | B2 | 1/2006 | Yoshio | |
| 7,254,005 | B2 * | 8/2007 | Oyama | 361/220 |
| 7,535,196 | B2 * | 5/2009 | Nagasawa | 320/114 |
| 2002/0036432 | A1 | 3/2002 | Nagao et al. | |
| 2002/0149266 | A1 | 10/2002 | Tahara | |
| 2003/0040228 | A1 | 2/2003 | Finzer et al. | |
| 2003/0220006 | A1 | 11/2003 | Gentry et al. | |
| 2004/0085692 | A1 | 5/2004 | Bodeau et al. | |
| 2004/0110397 | A1 | 6/2004 | Chen | |
| 2004/0169496 | A1 | 9/2004 | Rutter et al. | |
| 2004/0228053 | A1 | 11/2004 | Thiery et al. | |
| 2005/0037662 | A1 | 2/2005 | Sheng et al. | |
| 2005/0143846 | A1 | 6/2005 | Kocher et al. | |
| 2005/0170688 | A1 | 8/2005 | Chen | |
| 2005/0269880 | A1 | 12/2005 | Konishi | |
| 2005/0275983 | A1 | 12/2005 | Franklin et al. | |
| 2006/0035116 | A1 | 2/2006 | Kanouda et al. | |

FOREIGN PATENT DOCUMENTS

| | | |
|---|---|---|
| EP | 1335471 | 8/2003 |
| EP | 1605556 | 12/2005 |
| WO | WO 03/081777 | 10/2003 |

* cited by examiner

ELECTRICAL SHORTING SYSTEM

TECHNICAL FIELD

This invention relates generally to electrical shorting systems and more specifically, to a shorting system including an electrical switch.

BACKGROUND

"Shorting connectors" are electrical connectors that include shorting systems and may be used where it is necessary to short a circuit upon disconnection from another circuit. For example, shorting connectors may be used in current monitoring circuits that include current transformers or in an airbag activation circuit. However, many existing shorting connectors are at risk for inadvertently shorting at the wrong time during connection or disconnection of the electrical circuits because of mechanical failure in the moving parts of the shorting system of the electrical connector. Inadvertently shorting at the wrong time may damage a connected power supply requiring repair and potential replacement of the power supply.

For example, U.S. Pat. No. 4,971,568 or the "'568 patent" discloses an electrical connector assembly with attachment for automatically shorting select conductors upon disconnection of a connector. The shorting system of the '568 patent uses elongated arms that bend to contact a pin of the connector when it is disconnected from a receptacle. However, as the arms move back and forth, they may become lodged against a pin causing a short at the wrong time or may break over time and extended use.

The present invention is directed to overcome one or more of the problems as set forth above.

SUMMARY OF THE INVENTION

In one example of the present invention, an electrical shorting system is provided. The electrical shorting system may include an electrical switch having a first terminal, a second terminal, and a switching terminal. The electrical shorting system may include a housing that supports a first contact in electrical communication with the first terminal of the electrical switch and a second contact in electrical communication with the second terminal of the electrical switch. In some configurations, the housing may support the electrical switch, while in other configurations, the electrical switch may be disposed remotely from the housing.

The electrical switch may be placed in an open or closed state. To place the electrical switch in the open state, a voltage may be applied to the switching terminal. In the open state, the electrical switch impedes current flow through the electrical switch between the first contact and the second contact.

To place the electrical switch in the closed state, the applied voltage may be removed from the switching terminal, which permits the first contact to be shorted with the second contact through the electrical switch.

A method of using an electrical shorting system may include the step of obtaining the electrical shorting system in electrical communication with a power source such that electrical power is being conducted from the power source to the electrical shorting system. Since the electrical shorting system is in electrical communication with the power source, the electrical switch is in an open state that impedes current flow through the electrical switch between the first contact and the second contact. The method may also include the steps of disconnecting the electrical connector from the mating connector and placing the electrical switch in a closed state in which the first contact is shorted with the second contact through the electrical switch.

DETAILED DESCRIPTION

Figure 1:
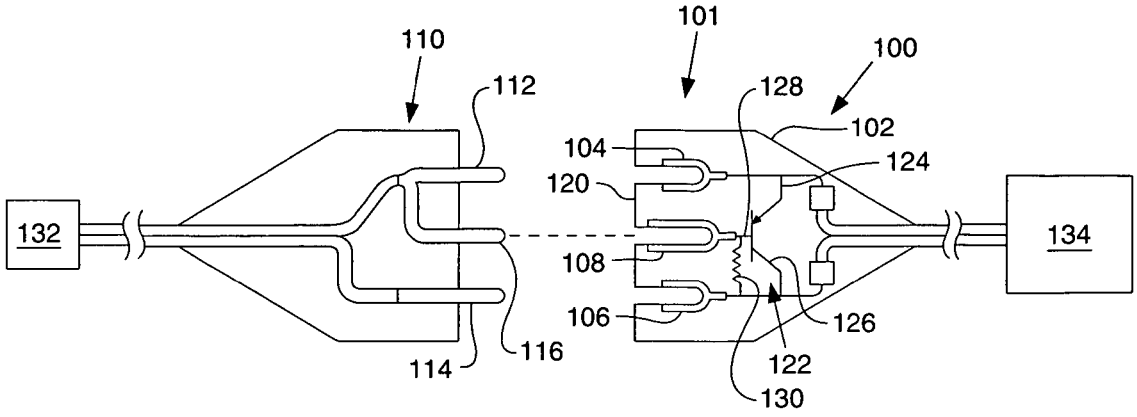
FIGS. 1, 2A, 2B, and 3 illustrate the electrical and mechanical components of electrical shorting systems.

FIG. 1 illustrates an electrical shorting system 100 embodied as a female connector 101 having a housing 102. The housing 102 supports a first contact 104, a second contact 106, and a switching contact 108 such that the electrical shorting system 100 may be coupled with a mating connector 110. When the electrical shorting system 100 is coupled with the mating connector 110, the first contact 104, the second contact 106, and the switching contact 108 respectively engage a first mating contact 112, a second mating contact 114, and a switching mating contact 116.

In some configurations of the mating connector 110, the first mating contact 112 and the switching mating contact 116 are electrically connected to apply a similar voltage to the first contact 104 and the switching contact 108. Additionally, the switching contact 108 may be positioned nearer to a coupling surface 120 of the housing 102 than the first and second contacts 104, 106. Consequently, when the mating connector 110 is coupled to the electrical shorting system 100, the switching contact 108 may engage the switching mating contact 116 before the first and second contacts 104, 106 engage the first and second mating contacts 112, 114.

As shown, the electrical shorting system 100 may also include an electrical switch 122 having a first terminal 124, a second terminal 126, and a switching terminal 128. As shown, the first contact 104 may be in electrical communication with the first terminal 124, and the second contact 106 may be in electrical communication with the second terminal 126 of the electrical switch 122. The switching contact 108 may be in electrical communication with the switching terminal 128.

The electrical switch 122 may be actuated by controlling the voltage applied to the switching terminal 128. When a voltage is applied to the switching terminal 128, the electrical switch 122 is placed in an open state that impedes current flow through the electrical switch 122 between the first contact 104 and the second contact 106. The open state of the electrical switch 122 prevents shorting of the first contact 104 with the second contact 106.

When a voltage is removed from the switching terminal 128, the electrical switch 122 is placed in a closed state in which the first contact 104 is shorted with the second contact 106 through the electrical switch 122. In other words, current is allowed to flow from the first contact 104 to the first terminal 124 and through the electrical switch 122 to the second terminal 126 and the second contact 106.

Once the power source has been disconnected from the electrical shorting system 100, the residual voltage on the switching terminal 128 is discharged by permitting current to pass across a resistor 130 that is in electrical communication with the switching terminal 128 and the second terminal 126. The resistor 130 may have a high resistance in order to minimize power loss between the switching terminal 128 and the second terminal 126 when the electrical shorting system 100 is in electrical communication with a power source 132, such as a battery, a solar cell, a generator, a thermoelectric generator, or other power source known in the art.

Consequently, when the power source 132 is removed from the electrical shorting system 100 by disconnecting the mating connector 110 from the first contact 104, the second contact 106, and the switching contact 108, the electrical shorting system 100 may facilitate the equalization of the electrical potential of the first contact 104, the second contact 106, and the switching contact 108. In other words, the first contact 104, the second contact 106, and the switching contact 108 may have the same electrical potential shortly after being disconnected from a power supply.

As shown, the first and second contacts 104, 106 may be in electrical communication with an electrical device 134 such that electrical power is delivered through the first and second contacts 104, 106 to the electrical device 134. Consequently, the electrical shorting system 100 may facilitate the discharge of electrical energy stored within the connected electrical device 134 by completing a circuit broken by decoupling the power source 132 from the electrical shorting system 100 and the electrical device 134.

In the illustrated configuration, the electrical switch 122 may be supported by the housing 102. Additionally, electrical switch 122 may be a transistor 122 and more specifically, may be a PNP transistor 122 such that the first terminal 124, the second terminal 126, and the switching terminal 128 are respectively an emitter 124, a collector 126, and a base 128.

Figure 2A:
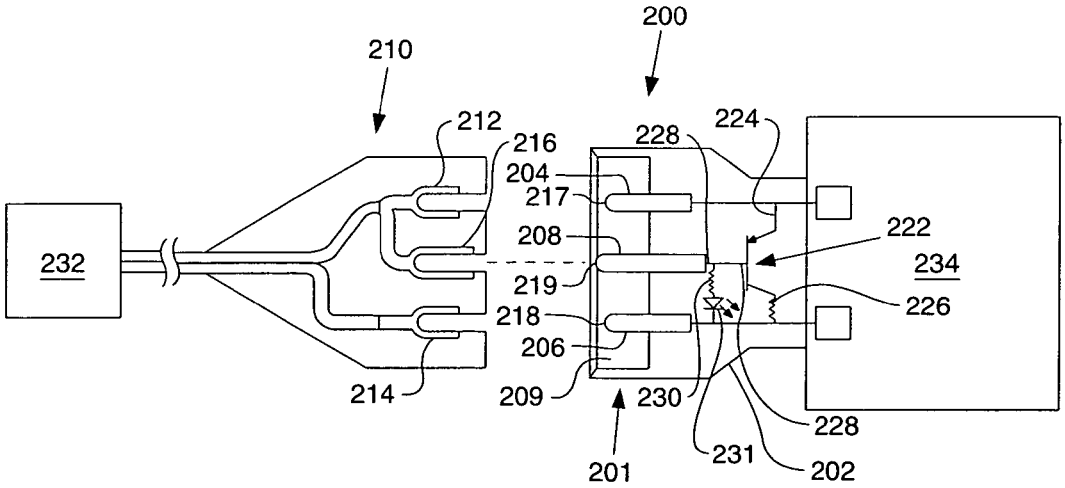

FIG. 2A illustrates another configuration of an electrical shorting system 200 embodied as a male connector 201 having a housing 202 that supports a first contact 204, a second contact 206, and a switching contact 208. The housing 202 may include a shroud 209 to prevent accidental contact with the first contact 204, the second contact 206, and the switching contact 208.

Like the electrical shorting system 100 of FIG. 1, the electrical shorting system 200 may be coupled with a mating connector 210 such that the first contact 204, the second contact 206, and the switching contact 208 respectively engage a first mating contact 212, a second mating contact 214, and a switching mating contact 216.

As shown, the first mating contact 212 and the switching mating contact 216 may be electrically connected to apply a similar voltage to the first contact 204 and the switching contact 208. Additionally, the first contact 204, the second contact 206, and the switching contact 208 may each have a respective end 217, 218, 219 that extends from the housing 202. The end 219 of the switching contact 208 may extend past the ends 217, 218 of the first and second contacts 204, 206 from the housing 202. Consequently, when the mating connector 210 is coupled to the electrical shorting system 200, the switching contact 208 may engage the switching mating contact 216 before the first and second contacts 204, 206 engage the first and second mating contacts 212, 214.

The electrical shorting system 200 may also include an electrical switch 222 having a first terminal 224, a second terminal 226, and a switching terminal 228. As shown, the first contact 204 may be in electrical communication with the first terminal 224, and the second contact 206 may be in electrical communication with the second terminal 226 of the electrical switch 222. The switching contact 208 may be in electrical communication with the switching terminal 228.

The electrical switch 222 may be supported by the housing 202 and may be a PNP transistor 222 such that the first terminal 224, the second terminal 226, and the switching terminal 228 are respectively emitter 224, a collector 226, and a base 228. As discussed above, the electrical switch 222 may be actuated by controlling the voltage applied to the switching terminal 228. Therefore, when a voltage is applied to the switching terminal 228, the electrical switch 222 is placed in an open state that impedes current flow through the electrical switch 222 between the first contact 204 and the second contact 206. When a voltage is removed from the switching terminal 228, the electrical switch 222 is placed in a closed state in which the first contact 204 is shorted with the second contact 106 through the electrical switch 222.

Voltage is allowed to drop on the switching terminal 228 by permitting current to pass across a resistor 230 and a light emitting diode 231 that is in electrical communication with the switching terminal 228 and the second terminal 226. The resistor 230 may have a high resistance in order to minimize power loss between the switching terminal 228 and the second terminal 226 when the electrical shorting system 200 is in electrical communication with a power source 232.

The light emitting diode 231 visually indicates when voltage is being applied to the switching terminal 228. In some configurations, a small amount of current may pass between the switching terminal 228 and the second terminal 226 to power the light emitting diode 231 as the second terminal 226 may have a different electrical potential than the switching terminal 228.

As shown, the electrical shorting system 200 may be connected to an electrical device 234 such that the first and second contacts 204, 206 may be in electrical communication with the electrical device 234. Thus, electrical power may be delivered through the first and second contacts 204, 206 to the electrical device 234.

The electrical shorting system 200 may also include a resistor 236 that may be electrically connected between the first and second contacts 204, 206 with the electrical switch 222. The resistor 236 may be used to discharge electrical power when the electrical switch 222 is placed in a closed state. Consequently, the electrical shorting system 200 may facilitate the discharge of electrical energy stored within the connected electrical device 234 by completing a circuit broken by decoupling the power source 232 from the electrical shorting system 200 and the electrical device 234.

Figure 2B:
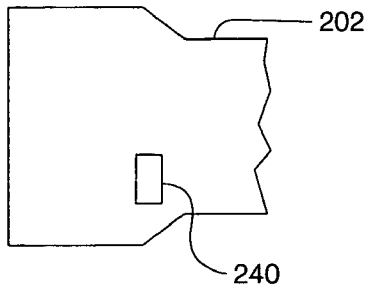

FIG. 2B illustrates an external surface of the housing 202 of the electrical shorting system 200. As shown, the housing 202 may include a window 240 that permits light generated by the light emitting diode 231 to be visible externally to the housing 202. Of course, the housing 202 may be made of a transparent material permitting the light to be viewed through the housing 202 without the optional window 240.

Figure 3:
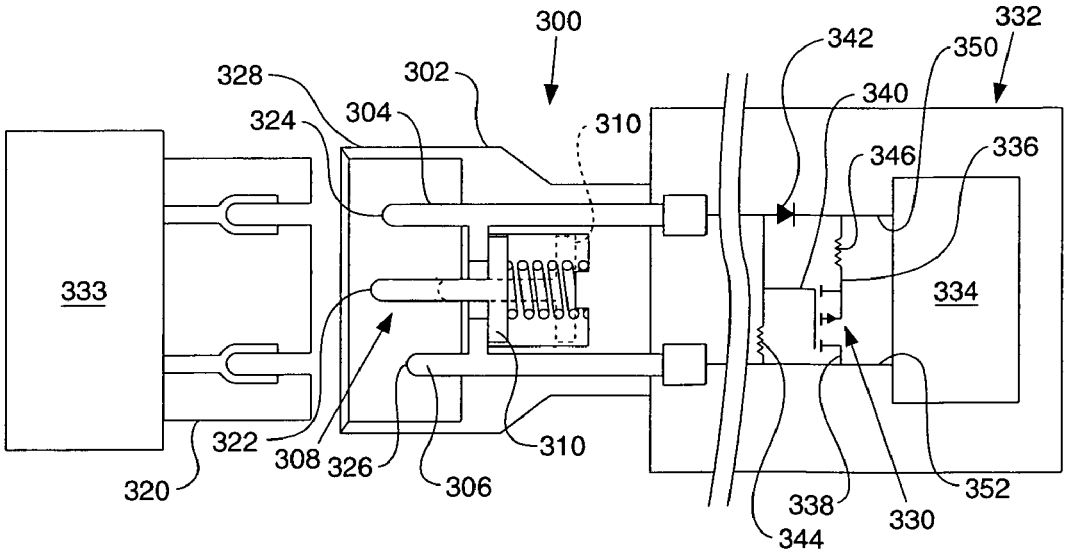

FIG. 3 shows another electrical shorting system 300 that may include a housing 302 that supports a first contact 304 and a second contact 306. The housing 302 also supports a mechanical shorting mechanism 308. The mechanical shorting mechanism 308 is a device that moves from a first position to a second position so that when the mechanical shorting mechanism 308 is in the first position, the first contact 304 is in electrical communication with the second contact 306. While the mechanical shorting mechanism 308 is in the second position, the mechanical shorting mechanism 308 does not electrically connect the first contact 304 with the second contact 306.

As shown, the mechanical shorting mechanism 308 may include a shorting arm 310 that moves between a first position and a second position. As shown, the shorting arm 310 is in the first position where the shorting arm 310 physically shorts the first contact 304 with the second contact 306. Conversely, when the shorting arm 310 is in the second position, as shown in phantom, the shorting arm 310 is remotely disposed from the first and second contacts 304, 306 so that the shorting arm 310 does not electrically connect the first contact 304 with the second contact 306. Consequently, when the electrical shorting system 300 is connected to a mating connector 320, the mechanical shorting mechanism 308 does not short the first contact 304 with the second contact 306. However, when the mating connector 320 is disconnected from the electrical shorting system 300, the mechanical shorting mechanism 308 shorts the first contact 304 with the second contact 306.

To ensure that the mechanical shorting mechanism 308 does not short the first contact 304 with the second contact 306 until after the mating connector 320 has been disconnected from the electrical shorting system 300, an end 322 of the shorting arm 310 may extend from the housing past the first and second contacts 304, 306 from the housing 302.

Additionally, the first contact 304 and the second contact 306 may each have a respective end 324, 326 that extends from the housing 302. The end 324 of the first contact 304 may extend past the end 326 of the second contact 306 from the housing 302. Consequently, when the mating connector 320 is coupled to the electrical shorting system 300, the first contact 304 may engage the mating connector 320 before the second contact 306 engages the mating connector 320.

The housing 302 may include a shroud 328 that may protect the first and second contacts 304, 306 from inadvertent contact. The shroud 328 may also ensure that a shorting arm 310 is moved from the first position to the second position by the mating connector 320 before the mating connector 320 contacts either the first or second contacts 304, 306.

The electrical shorting system 300 may also include an electrical switch 330 that may be disposed remotely from the housing 302. As shown, the electrical switch 330 may be incorporated into an electrical device 332. The electrical shorting system 300 may be disposed to permit electrical power from a power source 333 to be transmitted through the mating connector 320 and the electrical shorting system 300 to an electrical circuit 334 of the electrical device 332.

The electrical switch 330 may include a first terminal 336, a second terminal 338, and a switching terminal 340. As shown, the first contact 304 may be in electrical communication with the first terminal 336 and the switching terminal 340. In some configurations, the first terminal 336 may have a similar voltage as the switching terminal 340 when the power source 333 is in electrical communication with the electrical shorting system 300.

Because the first contact 304 may be in electrical communication with the first terminal 336 and the switching terminal 340, a one-way diode 342 may be disposed between the first terminal 336 and the first contact 304. The one-way diode 342 may prevent reverse current from flowing from the first terminal 336 and the first contact 304. The one-way diode 342 may also permit the voltage on the switching terminal 340 to be lower than the voltage on the first terminal 336 when the power source 333 is disconnected from the electrical shorting system 300.

The second contact 306 may be in electrical communication with the second terminal 338 of the electrical switch 330.

The electrical switch 330 may be a P-channel enhancement mode field-effect transistor such that the first terminal 336, the second terminal 338, and the switching terminal 340 are respectively a source 336, a drain 338, and a gate 340. Of course, the electrical switch 330 may be a power transistor so that the electrical shorting system 300 may be used in high power applications.

The electrical switch 330 may be any other type of transistor that may be configured to switch between the open state and the closed state, such as NPN transistors, metal oxide semiconductor field-effect transistors, insulated gate bipolar transistors, bipolar junction transistors, junction field-effect transistors, and N-channel field-effect transistors. Of course, a switching circuit may be used in order to place an NPN transistor or an N-channel field-effect transistor in the open state when the electrical shorting system 300 is connected from a power source 333 or the closed state when the electrical shorting system 300 is disconnected from a power source 333. Additionally, the electrical switch 330 may also include relays and solenoids that mechanically switch between the open state and the closed state similar to the mechanical shorting mechanism 308.

As discussed above, the electrical switch 330 may be actuated by controlling the voltage applied to the switching terminal 340. Therefore, when a voltage is applied to the switching terminal 340, the electrical switch 330 is placed in an open state that impedes current flow through the electrical switch 330 between the first contact 304 and the second contact 306.

Voltage is allowed to drop on the switching terminal 340 by permitting current to pass across a resistor 344 that is in electrical communication with the switching terminal 340 and the second terminal 338. In other words, when the electrical shorting system 300 is disconnected from a power source 333, voltage is no longer being applied to the switching terminal 340. Any residual voltage on the switching terminal 340 is allowed to pass to the lower electrical potential of the second terminal 338 across the resistor 344, which permits the switching terminal 340 and the second terminal 338 to quickly have a similar electrical potential.

The resistor 344 may have a high resistance in order to minimize power loss between the switching terminal 340 and the second terminal 338 when the electrical shorting system 300 is coupled to the mating connector 320.

When a voltage is removed from the switching terminal 340, the electrical switch 330 is placed in a closed state in which the first contact 304 is electrically connected with the second contact 306 through the electrical switch 330. In other words, the stored energy on the first terminal 336 is permitted to pass from the first terminal 336 through the electrical switch 330 to the second terminal 338.

The electrical shorting system 300 may also include a resistor 346 that may be electrically connected between the first and second contacts 304, 306 with the electrical switch 330. The resistor 346 may be used to discharge electrical power when the electrical switch 330 is placed in a closed state. Consequently, the electrical shorting system 300 may facilitate the discharge of electrical energy stored within the connected electrical circuit 334 by completing the electrical circuit 334 that is broken when a power source 333 is disconnected from the electrical shorting system 300 and the electrical device 332, while placing the first and second contacts 304, 306 at about the same electrical potential in a relatively short period of time. Thus, in some configurations, the resistor 346 may be a power resistor to facilitate the discharge of electrical power.

As shown, when the electrical shorting system 300 is connected to the power source 333, electrical power may be delivered from the electrical shorting system 300 to the electrical circuit 334 of the electrical device 332 by a positive line 350 and a ground (or negative) line 352.

INDUSTRIAL APPLICABILITY

The electrical shorting systems discussed above may be used to reduce the difference in electrical potential between the first contact and the second contact in a relatively short period of time after the electrical shorting system has been removed from electrical communication with a mating connector or a power source. Specifically, once the electrical shorting system has been disconnected from the power source, the electrical switch may be placed in a closed state in which the first contact is shorted with the second contact through the electrical switch.

Where the electrical shorting system includes a resistor in electrical communication with the switching terminal and the second terminal, the step of placing the electrical switch in a closed state may also include discharging the applied voltage on the switching terminal to the second terminal through the resistor.

The method may also include the step of indicating whether voltage is being applied to the switching contact. In some configurations, the electrical shorting system may include a light emitting diode in electrical communication with the switching terminal and the second terminal. Consequently, when voltage is being applied to the switching terminal, the light emitting diode may be powered to emit visible light indicating that voltage is being applied to the switching contact.

The method may also include the step of discharging electrical power through the resistor when the electrical switch is placed in a closed state in configuration where the electrical shorting system includes a resistor electrically connected between the first and second contacts with the electrical switch.

In some configurations, some redundancy has been added to the electrical shorting system by including a mechanical shorting mechanism to assure that the first contact will be shorted with the second contact once the electrical shorting system has been disconnected from a power source. Therefore, the method may also include the step of moving the mechanical shorting mechanism to short the first contact with the second contact.

Additionally, the electrical shorting system may include a one-way diode disposed between the first terminal and the first contact. The one-way diode blocks reverse current from passing between the first terminal and the first contact. Consequently, the voltage on the switching terminal may be about equal to or less than the voltage on the first terminal.

It will be apparent to those skilled in the art that various modifications and variations can be made without departing from the scope or spirit of the invention. Additionally, other embodiments of the invention will be apparent to those skilled in the art from consideration of the specification and practice of the invention disclosed herein. It is intended that the specification and examples be considered as exemplary only.

What is claimed is:

1. An electrical shorting system including a switch controlled electrical connector, the system comprising:

an electrical switch having a first terminal, a second terminal, and a switching terminal;

a housing;

a first contact in electrical communication with the first terminal of the electrical switch and supported by the housing;

a second contact in electrical communication with the second terminal of the electrical switch and supported by the housing, wherein the first and second contacts are disposed to engage corresponding contacts of a mating connector being in electrical communication with a power source; and wherein when the electrical switch is in a closed state, current is allowed to flow from the first contact to the second contact through the electrical switch so that the first contact is shorted with the second contact, wherein when a voltage is applied to the switching terminal via the first and second contacts being connected to the corresponding contacts of the mating connector, the electrical switch is placed in an open state that impedes current flow through the electrical switch between the first contact and the second contact.

2. The electrical shorting system of claim 1, further comprising a resistor in electrical communication with the switching terminal and the second terminal.

3. The electrical shorting system of claim 1, further comprising a light emitting diode that visually indicates when the voltage is being applied to the switching terminal.

4. The electrical shorting system of claim 1, wherein the electrical switch is a transistor such that the first terminal, the second terminal, and the switching terminal are respectively an emitter, a collector, and a base.

5. The electrical shorting system of claim 4, wherein the transistor is a PNP transistor.

6. The electrical shorting system of claim 1, wherein the electrical switch is a transistor such that the first terminal, the second terminal, and the switching terminal are respectively a source, a drain, and a gate.

7. The electrical shorting system of claim 6, wherein the transistor is a P-channel enhancement mode field-effect transistor.

8. The electrical shorting system of claim 1, further comprising a one-way diode disposed between the first terminal and the first contact.

9. The electrical shorting system of claim 1, wherein the first and second contacts are supported by the housing such that the first contact engages a mating connector before the second contact engages the mating connector.

10. The electrical shorting system of claim 1, further comprising a resistor electrically connected between the first and second contacts with the electrical switch.

11. The electrical shorting system of claim 1, further comprising a mechanical shorting mechanism.

12. The electrical shorting system of claim 1, wherein the first and second contacts are in electrical communication with an electrical device such that electrical power is delivered through the first and second contacts to the electrical device.

13. A method of shorting a first contact with a second contact of a switch controlled electrical connector of an electrical shorting system, the method comprising:

obtaining the electrical shorting system in electrical communication with a power source such that electrical power is being conducted from the power source to the electrical shorting system, wherein the electrical shorting system further includes a housing supporting the first and second contacts and an electrical switch having a first terminal, a second terminal, and a switching terminal, the first contact being in electrical communication with the first terminal of the electrical switch, the second contact in electrical communication with the second terminal of the electrical switch, wherein the first and second contacts are engaged with corresponding contacts of a mating connector, the mating connector being in electrical communication with the power source, wherein a voltage from the power source is applied to the switching terminal via the first and second contacts and the corresponding contacts of the mating connector such that the electrical switch is placed in an open state that impedes current flow through the electrical switch between the first contact and the second contact;

disconnecting the electrical shorting system from the power source; and placing the electrical switch in a closed state when power is no longer applied to the switching terminal via the first and second contacts and the corresponding contacts of the mating connector in which current is allowed to flow from the first contact to the second contact through the electrical switch so that the first contact is shorted with the second contact.

14. The method of claim 13, wherein the electrical shorting system further includes a resistor in electrical communication with the switching terminal and the second contact, the method comprising discharging a residual voltage on the switching terminal to the second contact through the resistor.

15. The method of claim 13, wherein the electrical shorting system further includes a light emitting diode such that the method further comprising indicating when the voltage is being applied to the switching terminal.

16. The method of claim 13, wherein the electrical switch is a PNP transistor such that the first terminal, the second terminal, and the switching terminal are respectively an emitter, a collector, and a base.

17. The method of claim 13, wherein the electrical switch is a P-channel enhancement mode field-effect transistor such that the first terminal, the second terminal, and the switching terminal are respectively a source, a drain, and a gate.

18. The method of claim 13, wherein the electrical shorting system further includes a resistor electrically connected between the first and second contacts with the electrical switch, the method further comprising discharging electrical power through the resistor when the electrical switch is placed in the closed state.

19. The method of claim 13, wherein the electrical shorting system further includes a mechanical shorting mechanism, the method further comprising moving the mechanical shorting mechanism to short the first contact with the second contact.

20. The method of claim 13, wherein the electrical shorting system further includes a one-way diode disposed between the first terminal and the first contact.

* * * * *